US008434622B2

(12) United States Patent
Kasiwabara

(10) Patent No.: US 8,434,622 B2
(45) Date of Patent: May 7, 2013

(54) ARTICLE PACKAGING UNIT

(75) Inventor: Kouichi Kasiwabara, Koutou-ku (JP)

(73) Assignee: Yamato Packing Technology Institute Co., Ltd., Tokyo (JP)

( * ) Notice: Subject to any disclaimer, the term of this patent is extended or adjusted under 35 U.S.C. 154(b) by 0 days.

(21) Appl. No.: 13/138,683

(22) PCT Filed: Mar. 19, 2010

(86) PCT No.: PCT/JP2010/054795

§ 371 (c)(1),
(2), (4) Date: Sep. 19, 2011

(87) PCT Pub. No.: WO2010/110202

PCT Pub. Date: Sep. 30, 2010

(65) Prior Publication Data

US 2012/0006714 A1 Jan. 12, 2012

(30) Foreign Application Priority Data

Mar. 26, 2009 (JP) ..... 2009-076896

(51) Int. Cl.
*B65D 81/05* (2006.01)

(52) U.S. Cl.
USPC ..... 206/522; 206/524; 220/254.3

(58) Field of Classification Search ..... 206/521, 206/522; 220/243, 244, 254.1, 254.3, 729, 220/742–743, 752, 754, 755, 774; 229/117.34
See application file for complete search history.

(56) References Cited

U.S. PATENT DOCUMENTS

| | | | | | |
|---|---|---|---|---|---|
| 2,578,107 | A | * | 12/1951 | Thacker et al. | 206/703 |
| 4,145,973 | A | * | 3/1979 | Baxter | 410/119 |
| 4,170,297 | A | * | 10/1979 | Johnson | 206/326 |
| 4,649,813 | A | * | 3/1987 | Kehl | 100/227 |
| 5,009,318 | A | | 4/1991 | Lepinoy | |
| 5,226,543 | A | * | 7/1993 | Foos et al. | 206/592 |
| 5,351,830 | A | * | 10/1994 | Bender et al. | 206/524.8 |
| 5,499,735 | A | * | 3/1996 | Chen | 220/231 |
| 5,515,975 | A | * | 5/1996 | Jarvis et al. | 206/584 |
| 5,595,806 | A | * | 1/1997 | Korfmacher | 428/69 |
| 5,788,078 | A | * | 8/1998 | Fuss | 206/521 |
| 5,901,850 | A | * | 5/1999 | Jones et al. | 206/522 |
| 6,334,534 | B1 | * | 1/2002 | Hollingsworth et al. | 206/320 |

(Continued)

FOREIGN PATENT DOCUMENTS

| | | |
|---|---|---|
| JP | S64-009181 | 1/1989 |
| JP | 2001-163361 | 6/2001 |

(Continued)

*Primary Examiner* — J. Gregory Pickett
*Assistant Examiner* — Mollie Llewellyn
(74) *Attorney, Agent, or Firm* — Manabu Kanesaka

(57) ABSTRACT

[Object] To protect a large-sized article or a large number of articles from impacts and vibrations applied thereto during transportation.

[Solution Means] An article packaging unit includes a combination of an outer box 1 and a packaging mat 2. The outer box 1 is an openable and closable container for storing articles, and has a cushion 4 for supporting an article P inside. The packaging mat 2 is formed by filling cushioning bodies in an airtight bag, and attached to an inner lid 3 attached to the outer box 1. When the inside of the packaging mat 2 is deaerated, the cushioning bodies increase the filling density, solidify the packaging mat 2, and come into close contact with the surface of an article P stored in the outer box 1 and hold the article P at a fixed position.

8 Claims, 10 Drawing Sheets

U.S. PATENT DOCUMENTS

| | | | | |
|---|---|---|---|---|
| 6,951,283 | B2 * | 10/2005 | Savoie | 206/577 |
| 7,383,953 | B2 * | 6/2008 | Dickinson | 206/522 |
| 2002/0108886 | A1 * | 8/2002 | Kim | 206/586 |
| 2005/0252826 | A1 * | 11/2005 | Boeller et al. | 206/593 |
| 2009/0084786 | A1 * | 4/2009 | Claypool et al. | 220/254.9 |

FOREIGN PATENT DOCUMENTS

| | | | |
|---|---|---|---|
| JP | 2001-321217 | | 11/2001 |
| JP | 2008-074451 | | 4/2008 |
| WO | WO 9418091 | * | 8/1994 |

* cited by examiner

ARTICLE PACKAGING UNIT

RELATED APPLICATIONS

The present application is National Phase of International Application No. PCT/JP2010/054795 filed Mar. 19, 2010, and claims priority from Japanese Applications No. 2009-076896, filed Mar. 26, 2009.

TECHNICAL FIELD

The present invention relates to an article packaging unit suitable for delivery of an article, specifically, a large-sized article.

BACKGROUND ART

When transporting an article, in order to effectively protect the article from impacts and vibrations that may be applied thereto during transportation, normally, a cushioning material having shock-absorbing characteristics such as paper, a plastic sheet, or the like is used to pack the article, and further, filling is filled in an outer box so as to prevent the article from moving as appropriate and the article is packed in the outer box.

For example, when a comparatively large-sized article such as a desktop personal computer is transported, there is a case where the article is delivered from a factory to a distributor or a mass retailer as a destination of shipment and a case where the article is delivered to a home of a purchaser who purchased the article from a mass retailer. Recently, in home-delivery services, requests for delivery of products such as desktop personal computers, notebook computers, and digital cameras to manufacturers and repair centers of mass retailers have rapidly increased. These products are normally packed in exclusive packing boxes when consumers purchase the products from mass retailers and retail stores, and if the boxes are not disposed of but are left as they are, they can be reused at the time of request for repair, however, in actuality, such boxes are disposed of immediately after the purchase of the products, so that in the case of request for repair, an available box is used.

Of course, home delivery service companies prepare boxes of various sizes to meet customer requests, however, the sizes and shapes of products are diverse, and it is difficult to satisfactorily pack all products in boxes that home delivery service companies prepare.

A product packing state differs between the time of sale of the product and the time of request for repair of the product. Specifically, at the time of sale of a product that will be requested to be delivered to a manufacturer or repair center of a retail store, individual packing is necessary, that is, it is necessary to pack articles individually and, for increasing the commodity value of the article, apply an appropriate material and container for protecting the articles, however, when a person requests a home delivery service person to transport a product to be repaired, "individual packing" as in the case of product sale is not necessary, but the product must be effectively protected from impacts and external forces that may be applied thereto during transportation.

Therefore, when delivering an article to a manufacturer or a repair center of a mass retailer, it is convenient that the article is put in an available empty box or bag and directly transported. However, a simple cardboard box, paper bag or vinyl bag cannot secure safety against impacts etc. When using a bag, a special measure for protecting a product from impacts is necessary. For example, Patent Document 1 describes a package including a bag-shaped article storing portion for storing articles and a bag-shaped cushioning portion which is connected to at least a portion of the periphery of the article storing portion and reduces impacts applied from the outside to the article storing portion by cushioning materials sealed inside.

Patent Document 2 describes a bag using a heat-insulating effect of foamed granular bodies as a temperature-keeping bag to be used as a shopping bag although it is not a bag for article transportation. This temperature-keeping bag is a double bag, having an inner bag portion and an outer bag portion which form a granular body storing portion therebetween and are freely deformable, and includes a bag main body that is formed so as to store an object to be kept in temperature, and is non-breathable on at least the side of the outer bag portion of the bag portions, numerous foamed granular bodies which are stored in the granular body storing portion and gather together in a close-contact state and turn into a solidified state as the granular body storing portion is deaerated, and an air intake and exhaust port that is provided in the bag main body and communicatively connected to the granular body storing portion, and includes an air intake valve for keeping the deaerated state of the granular body storing portion.

The effect of the temperature-keeping bag described in Patent Document 2 is emphasized in which, by solidifying numerous foamed granular bodies stored in the granular body storing portion along the shape of the object to be kept in temperature, heat loss due to circulation of air around the object to be kept in temperature inside the bag main body is eliminated, and the foamed granular body group can insulate heat, so that changes in temperature of the object to be kept in temperature can be reduced for a long period of time, and by positioning the object to be kept in temperature by the solidified foamed granular bodies so as to prevent this from moving inside the bag main body, the object to be kept in temperature can be prevented from being deteriorated in quality due to movement of the object to be kept in temperature.

The temperature-keeping bag described in Patent Document 2 uses the heat-insulating effect of the foamed granular body group for temperature keeping of the object to be kept in temperature by solidifying the foamed granular body group along the shape of the object to be kept in temperature, and it can be expected that positioning of the object to be kept in temperature by the solidified foamed granular bodies so as to prevent the object to be kept in temperature from moving inside the bag main body will provide not only a heat-insulating effect but also a cushioning effect by the solidified foamed granular body group, and it can also be expected that stable holding of the article at a fixed position will provide a great effect in packing of the article to be transported by home delivery service.

PRIOR ART DOCUMENTS

Patent Documents

Patent Document 1: Japanese Published Unexamined Patent Application No. 2008-74451

Patent Document 2: Japanese Published Unexamined Patent Application No. 2001-321217

SUMMARY OF THE INVENTION

Problem to be Solved by the Invention

However, although it can be expected that positioning of the object to be kept in temperature by the solidified foamed granular bodies so as to prevent the object to be kept in temperature from moving inside the bag main body will provide not only a heat-insulating effect but also a cushioning effect, neither the idea of effective utilization of this function nor the idea of effective utilization of the foamed granular bodies solidified by deaeration for shape-keeping and holding of an article is approved. When packing an article to be transported by home delivery service, the biggest challenge is to stably hold the article (product) inside a bag or box and effectively protect the article (product) from vibrations and impacts that may be applied thereto during transportation.

Means for Solving the Problem

In order to solve the above-described problem, the biggest feature of the present invention is that a combination of an outer box and a packaging mat formed by filling cushioning bodies in an airtight bag is used, and by solidifying the cushioning bodies by deaerating the inside of the packaging mat, the packaging mat is fixed to the surface of a product stored in the outer box, and the product is stably held between the packaging mat and the outer box by fixing the solidified packaging mat to the outer box.

Effects of the Invention

In an article packaging unit according to the present invention, the surface of a packaging mat is brought into contact with the surface of an article stored, the packaging mat is solidified along the surface shape of the article by deaerating the inside of the bag and supports at least one surface of the article, and a cushioning effect is generated by the solidification of cushioning bodies, and the product can be safely protected from impacts and vibrations that may be applied thereto during transportation, and a home delivery service person carries the article packaging unit according to the present invention and a pump to a consolidating point when picking-up the article, and can easily pack the article by boxing the article and deaerating the inside of the packaging mat with the pump at the consolidating point, and at a delivery destination, by opening the outer box and refilling the inside of the packaging mat with air by using a pump, the article can be easily unpacked.

In particular, according to the present invention, a cushion that supports an article is installed in advance in the outer box, and by supporting another surface of the article supported by the cushion by the solidified packaging mat, the article is stably supported inside the outer box by using both the cushion and the solidified packaging mat, and the article can be effectively protected from impacts and vibrations that may be applied to the package box during transportation.

Further, by attaching the packaging mat to the inner surface of the inner lid of the outer box, the article can be taken out from and put into the outer box in a state where the inner lid is opened, and by closing the inner lid in a state where the article is stored in the outer box, the packaging mat can be made to fit the surface shape of the article, and by deaerating the inside of the packaging mat in this state, the article can be fixed and held at a fixed position by the solidified packaging mat. By packing the pump inside the same inner lid, it can be prevented that the pump is lost and forgotten to be carried which would result in the impossibility of packing and unpacking.

BRIEF DESCRIPTION OF THE DRAWINGS

FIG. 6(*a*) and FIG. 6(*b*) show a front center longitudinal section of the valve, and FIG. 6(*c*) shows a side center longitudinal section of the same.

BEST MODE FOR CARRYING OUT THE INVENTION

Figure 1:
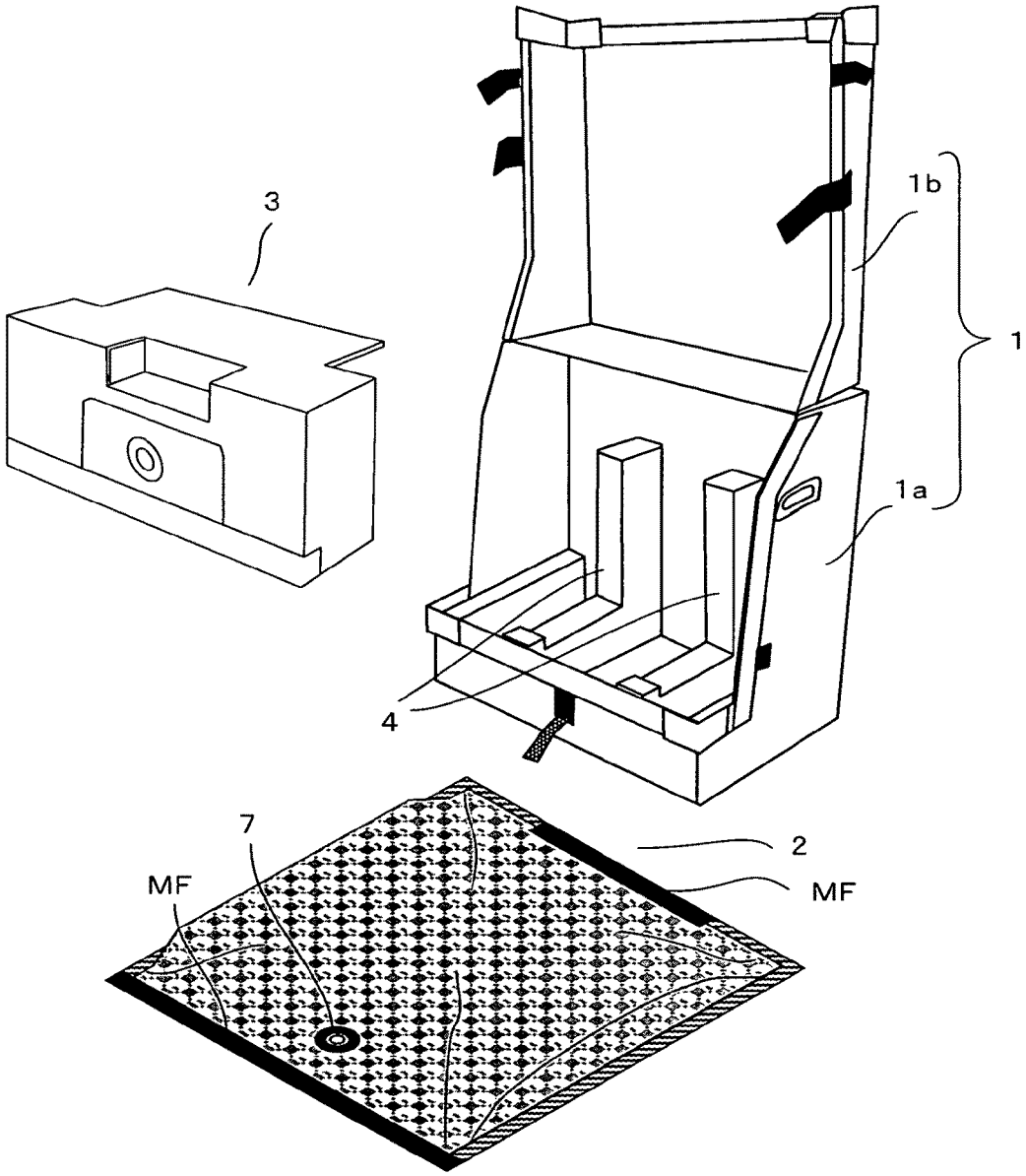
FIG. 1 is an exploded view of an article packaging unit showing Example 1 of the present invention.
Figure 2:
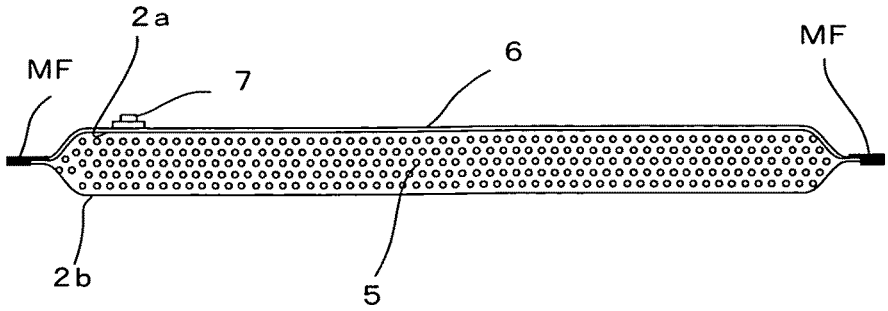
FIG. 2 is a sectional view of a packaging mat.

Hereinafter, an embodiment of the present invention will be described in detail. In FIG. 1, an article packaging unit according to the present invention includes at least a combination of an outer box 1 and a packaging mat 2. The outer box 1 is a hollow square container that stores an article to be packed, and the packaging mat 2 is formed by filling cushioning bodies 5 in an airtight bag as shown in FIG. 2, and at least a portion of the packaging mat 2 is removably attached to the inside of the outer box 1 and has a valve 7.

Figure 6A:
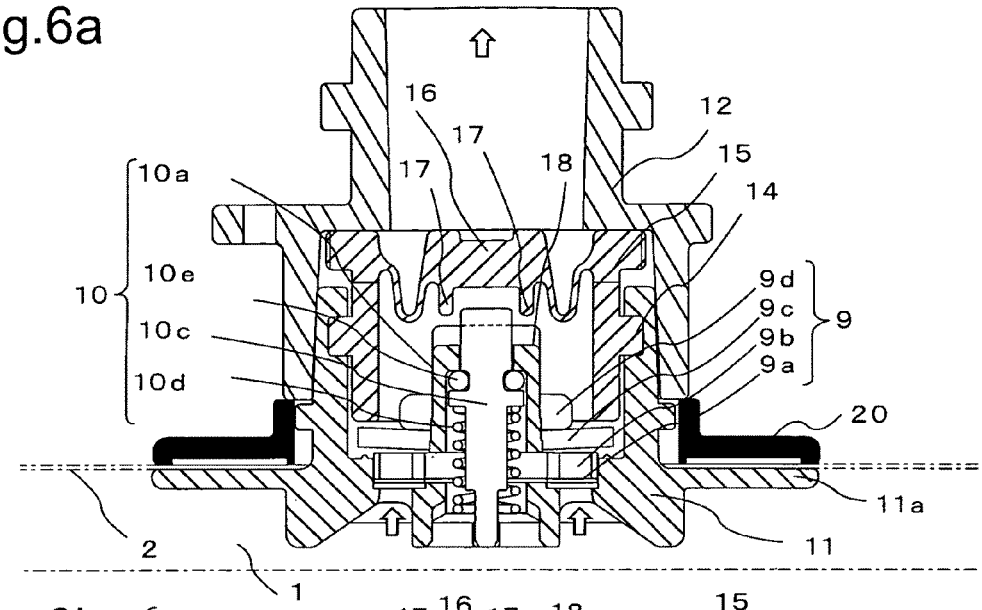
FIG. 6 are views showing a structure of a valve, FIG. 6(*a*) shows a state where a check valve is opened, FIG. 6(*b*) shows a state where an air intake valve is opened, and FIG. 6(*c*) shows a state where the valve opening operation of the air intake valve is disabled.
Figure 6B:
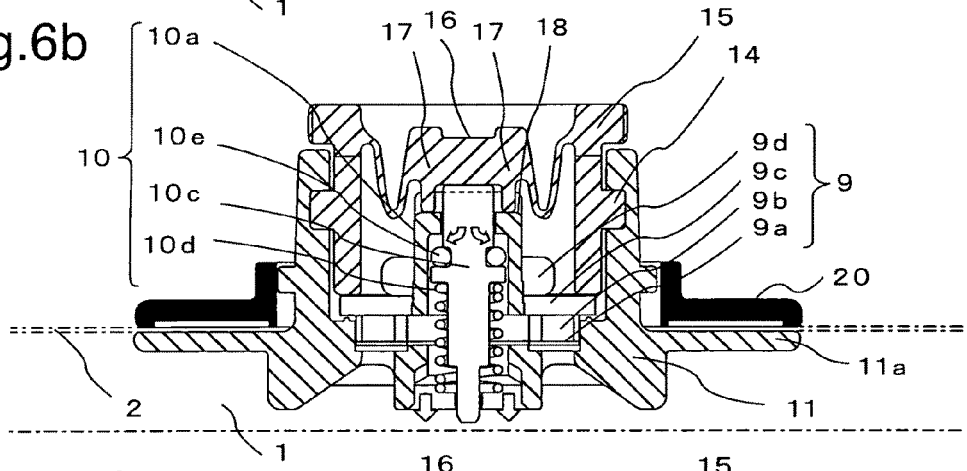
Figure 6C:
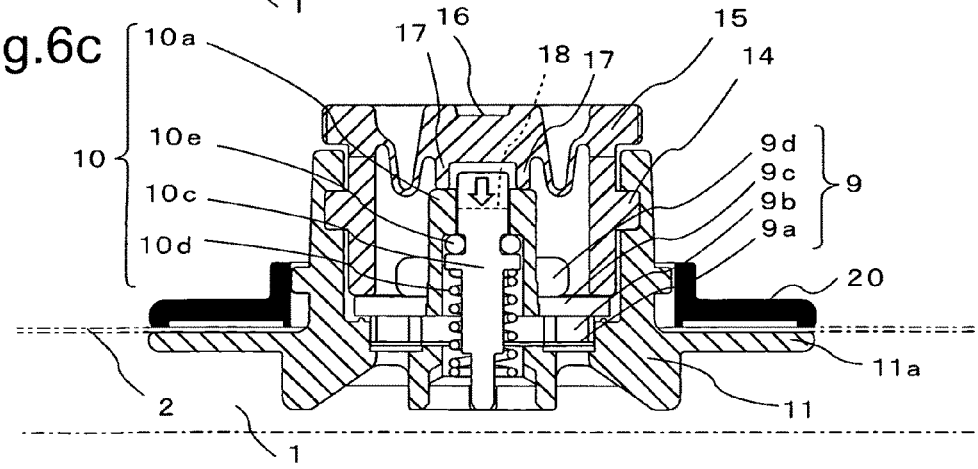

The cushioning bodies 5 have a function to bring the packaging mat into close contact with the surface of the article and reduce impacts to be applied to an article from the outside by fitting the shape of the article packed with the packaging mat and increasing the filling density inside the bag body when the air inside the bag body of the packaging mat is deaerated and the internal capacity of the bag body is reduced, and the valve 7 consists of a combination of a check valve and an air intake valve as described later, and as shown in FIG. 6, the check valve 9 opens when a suction force of a pump is applied when deaerating the inside of the packaging mat 2, and after the deaeration, closes to block introduction of the outside air into the packaging mat 2, and the air intake valve 10 makes it possible to introduce the outside air into the inside of the packaging mat 2 deaerated by a manual valve opening operation. The deaerated packaging mat 2 becomes solidified and comes into close contact with the surface of an article P stored in the outer box 1 and holds the article P at a fixed position.

The outer box 1 has a cushion 4 inside. The cushion 4 holds the article P stored in the outer box 1 in conjunction with the solidified packaging mat 2 at a fixed position. Further, the outer box 1 has a mat holder (shown as an inner lid 3 in FIG. 1). This mat holder supports the packaging mat 2 and presses a portion of the packaging mat against the surface of the article P stored in the outer box 1 before the inside of the packaging mat 2 is deaerated. The packaging mat 2 pressed against the surface of the stored article P wraps the article P and becomes solidified when the air inside is deaerated, and stably holds the article P at a fixed position inside the outer box 1.

By attaching the mat holder as an inner lid 3 to an opening of the outer box 1 in an openable and closable manner, the packaging mat 2 can be made to fit three or more of the surfaces of the article stored in the outer box when the inner lid 3 is closed.

EXAMPLE 1

An example of the present invention is shown in FIG. 1. In this example, the article packaging unit includes a combination of an outer box 1, a packaging mat 2, and an inner lid 3. The outer box 1 is a container for storing an article, and in this example, the outer box 1 consists of a box main body 1*a* and an outer lid 1*b*, and the box main body 1*a* is a hollow square container opened from a portion of the front surface to a portion of the upper surface, and the outer lid 1*b* is joined to an upper edge opening edge of the box main body 1*a* so as to rise and fall to open and close the opening of the box main body 1*a*. In this example, inside the box main body 1*a*, two protrusions of foamed plastic with a fixed thickness are provided at a fixed interval across the bottom surface and the back surface of the inside of the box main body 1*a* as a cushion 4 that supports the stored article.

The packaging mat 2 is formed by filling cushioning bodies 5 in an airtight bag formed by laminating a rectangular surface sheet 2*a* and backside sheet 2*b* that are airtight up and down and sealing the peripheral edges as shown in FIG. 2, and the outer surface of the surface sheet 2*a* is covered by an outer sheet 6 and has a valve 7.

The cushioning bodies 5 have a function to reduce impacts to be applied to an article from the outside by bringing the mat 2 into close contact with the surface of the article by fitting the shape of the article packed with the packaging mat 2 and increasing the filling density inside the bag body when the air inside the bag body of the packaging mat 2 is evacuated and the internal capacity of the bag body is reduced. Materials having this function are, for example, beads of a synthetic resin foamed material, and are filled in the packaging mat 2. The valve 7 is for deaerating the air inside the packaging mat 2 or suctioning the outside air to the inside, and is attached so as to penetrate through the sheet surface of the surface sheet 2*a* and the outer sheet 6 and position an air intake and exhaust port near the end edge of the valve 7. The outer sheet 6 is for protecting the sheet surface of the surface sheet 2*a*.

Figure 3:
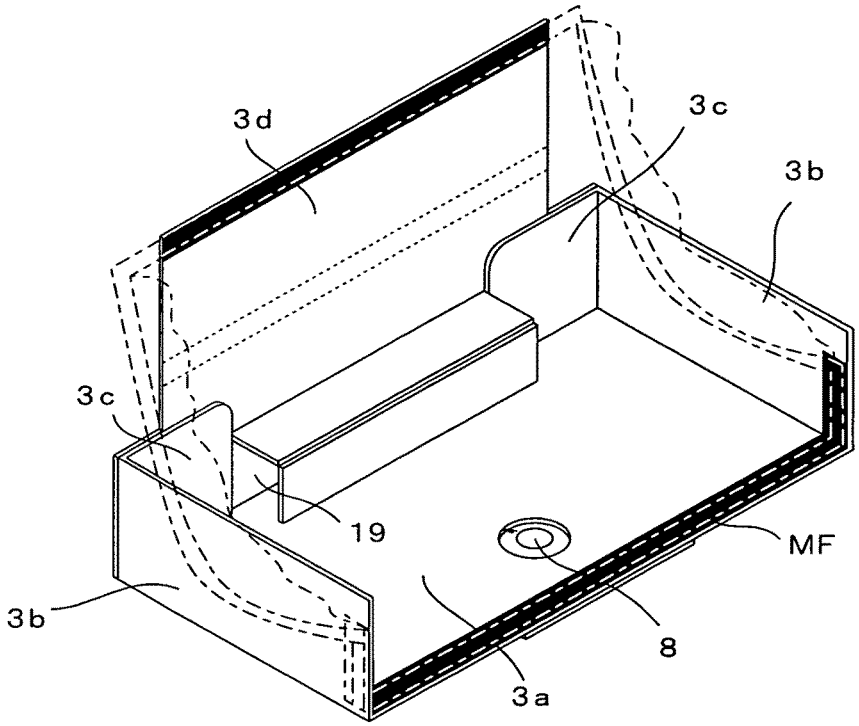
FIG. 3 is a perspective view of an inner lid.

The inner lid 3 is a mat holder supporting the packaging mat 2, and in this example, the inner lid is supported on the box main body 1*a* so as to rise and fall, and is used as an inner lid for opening and closing the upper portion opening of the box main body 1*a*. In this example, as shown in FIG. 3, the inner lid 3 assumes a box shape which is opened at one surface (front surface) and has rising surfaces 3*b* on both sides of the bottom surface 3*a*, and in a portion of the bottom surface 3*a* of the inner lid 3, a small hole 8 that an exhaust port of the valve 7 of the packaging mat 2 faces is opened, and to the back surface 3*c*, a flap 3*d* is attached so as to rise and fall, and a pump storage space 19 described later is provided across the bottom surface 3*a* and the back surface 3*c*.

Figure 4:
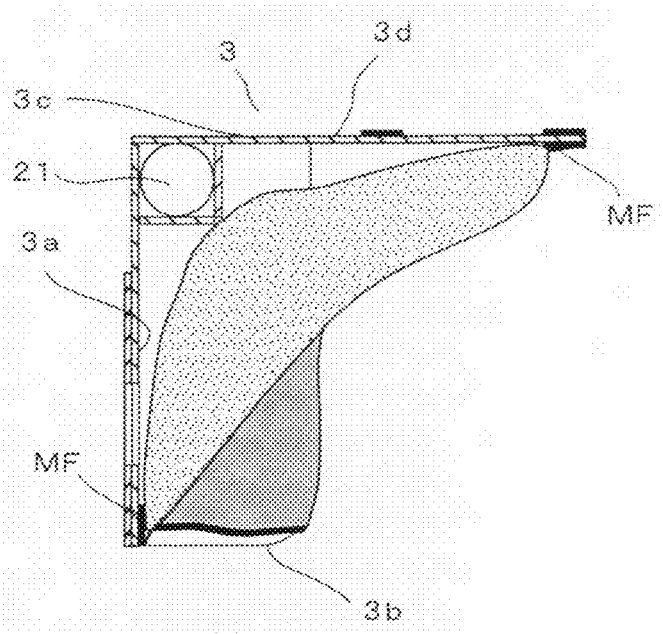
FIG. 4 is a view showing a state where the packaging mat is attached to the inner lid.
Figure 5:
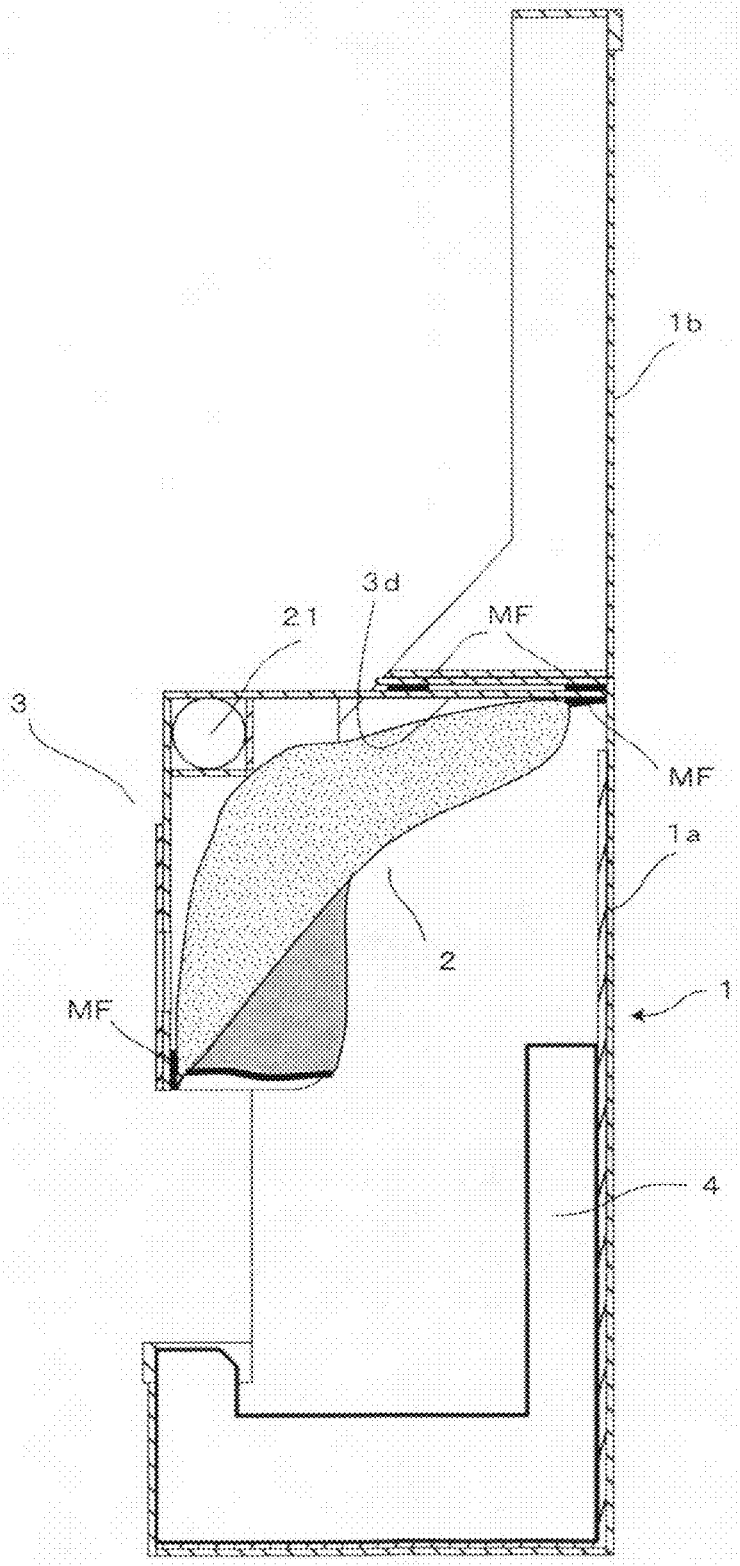
FIG. 5 is a view showing a state where the inner lid to which the packaging mat is attached is attached to a box main body of an outer box.

In this example, the packaging mat 2 is attached across the outer edge of the flap 3*d* and the end edge of the bottom surface 3*a* as shown in FIG. 4. As the packaging mat 2, a mat with a width sufficiently wider than the width of the bottom surface 3*a* of the inner lid 3 is used, and as shown in FIG. 3, hook-and-loop fasteners MF are attached to the outer edge of the flap 3*d* and the tip end of the bottom surface 3*a* of the inner lid 3, and on the tip end of the bottom surface 3*a*, the hook-and-loop fastener MF is stuck to extend to rising surfaces 3*b* and 3*b* on both sides of the bottom surface and the packaging mat 2 is attached across the outer end of the flap 3*d* and the outer end of the bottom surface 3*a* of the inner lid 3, and both side edges of the packaging mat 2 are folded along the rising surfaces 3*b* and 3*b* and removably attached thereto. The inner lid 3 is inserted in the box main body of the outer box 1 as shown in FIG. 5, and the flap 3*d* of the inner lid 3 is attached to the upper bottom inner surface of the box main body 1*a*. In this example, the inner lid 3 is removably attached to the inside of the outer box 1 by using the hook-and-loop fasteners MF.

As the surface sheet 2*a* and the backside sheet 2*b* of the packaging mat 2, thermoplastic polyurethane sheets or vinyl chloride sheets are used, and for the outer sheet 6, a thermoplastic polyurethane sheet, vinyl chloride sheet, laminate film of flexible metallocene-based polyethylene and EVOH/polyethylene or laminate film of metallocene-based polyethylene and gas barrier nylon, nylon 6, nylon 66 base cloth/thermoplastic urethane tarpaulin, nylon 6, nylon 66 base cloth/vinyl chloride tarpaulin, or polyester base cloth/thermoplastic urethane tarpaulin or polyester base close/vinyl chloride tarpaulin is used.

In the present invention, the cushioning bodies 5 are beads of foamed plastic with shock-absorbing characteristics. When beads are used as cushioning bodies, it is preferable that the beads are filled without partial bias inside the packaging mat 2.

The beads are granular bodies of foamed polyethylene or foamed polystyrene, and as the grain diameter becomes smaller, the beads can more satisfactorily fit the shape of an article although the grain diameter is not limited.

The structure of the valve 7 is shown in FIG. 6. The valve 7 consists of a combination of a check valve 9 and an air intake valve 10, and at the center of the inside of a cylindrical valve cage 11 having a flange 11*a* on the bottom, the air intake valve 10 is installed, and around the air intake valve 10, the check valve 9 is installed. The flange 11*a* is a support that airtightly supports the valve cage 11 from the inside of the packaging mat 2, and the valve cage 11 is fastened and fixed by the ring 20 while sandwiching the surface sheet 2*a* and the outer sheet 6 of the packaging mat 2. The check valve 9 opens when a suction force of a pump is applied thereto for deaerating the inside of the packaging mat 2, and after the deaeration, closes to block introduction of the outside air into the packaging mat 2, and the air intake valve 10 is opened by a manual valve opening operation of depressing a push button 16 to allow the outside air to be introduced into the inside of the deaerated packaging mat 2.

The valve cage 11 is removably coupled to a coupler 12 fitted to the pump 21 (or to a suction port of a hose connected to the pump). FIG. 6(*a*) shows a state where the check valve 9 is opened by suctioning by the pump 21 and the air inside the packaging mat 2 is deaerated, FIG. 6(*b*) shows a state where the air intake valve 10 is opened and air is introduced into the packaging mat 2, and FIG. 6(*c*) shows a state where a valve opening operation is blocked to prevent the air intake valve 10 from opening. The air intake valve 10 consists of a combination of a tubular portion 10*a* projecting at the center of the valve cage 11, and a valve stem 10*c* for opening and closing the valve port inside the tubular portion 10*a*, and a coil spring 10*d* is fitted to the outside of the valve stem 10*c*, and a rubber packing 10*e* is fitted to the neck portion of the valve stem 10*c*, and by applying a resilient force of the coil spring 10*d* to the valve stem 10*c*, a spring presser 10*f* is supported on the inner wall of the tubular portion 10*a*, the rubber packing 10*e* is brought into pressure contact with the port edge of the valve port, and accordingly, the valve port is normally held in a valve closed state.

Figure 7A:
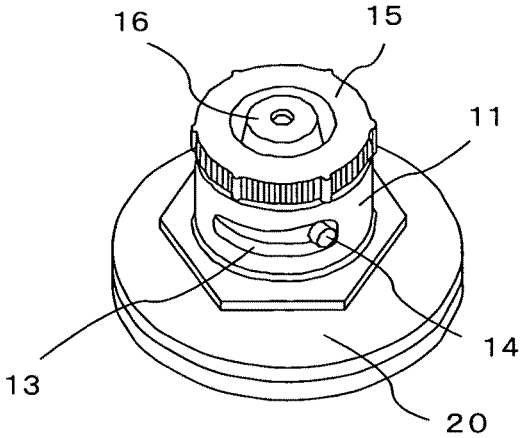
FIG. 7 are perspective views of the valve, FIG. 7(*a*) is a view showing a position of a knob at which the air intake valve is openable, and FIG. 7(*b*) is a view showing a state where the valve opening operation of the air intake valve is disabled by rotating the knob.
Figure 7B:
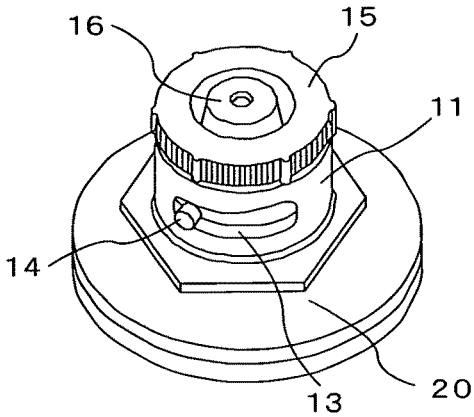

In the outer wall of the valve cage 11, a cam groove 13 is opened spirally in a rising direction (refer to FIG. 7). In the valve cage 11, a knob 15 having a projection 14 to be engaged in the cam groove 13 is fitted turnably. The knob 15 has an operating push button 16 capable of being depressed by using elasticity of the material on the head portion, and on the lower surface of the push button 16, a stay 17 to be brought into contact with the apex of the tubular portion 10*a* into which the valve stem 10*c* is inserted is provided so as to project.

On the other hand, the tubular portion 10*a* has a recess 18 on the apex. FIG. 7(*a*) shows a state where the projection 14 is at the right end of the cam groove 13 diagonally rising up rightward in the drawing (a position at which the projection 14 is lifted maximally), and the air intake valve is allowed to be opened by the push button 16. FIG. 7(*b*) is a state where the projection 14 is at the left end of the cam groove 13 in the drawing (a position at which the projection 14 is pressed down) and the air intake valve 10 is not allowed to be opened.

In this example, when the stay 17 is at a position deviating from the recess 18, the air intake valve 10 cannot be opened. At times other than air intake, the stay 17 is brought into contact with the head portion of the tubular portion 10*a* by rotating the knob 15 so as to prevent the push button 16 from being depressed. On the other hand, the check valve 9 consists of a combination of a filter 9*a*, a ring 9*b* having a valve port between radial ribs, and a valve plate 9*c* made of a soft material, and is installed on the outer periphery of the air intake valve 10 around the tubular portion 10*a*.

To assemble the check valve 9, first, the filter 9*a* is supported and set on the edge of the annular opening formed around the tubular portion 10*a*, and then, the ring 9*b* is fitted, and further, the valve plate 9*c* is inserted and held on the tubular portion 10*a* by a pressure applied by a holder 9*d* from above. The valve cage 11 attached to the mat 2 is drawn out to the surface of the outer sheet 6 from a small hole opened in the outer sheet 6, and held at a fixed position in a state where the ring 20 is fitted from above and the valve cage 11 is airtightly sealed to the lamination of the outer sheet 6 and the mat 2.

Next, a usage example of the article packaging unit according to the present invention will be described. The packaging mat 2 is stored in a package box according to the present invention in a state where the packaging mat 2 is supported on the inner lid 3, and the pump 21 is stored in the storage space 19 of the inner lid 3, and the box main body la of the outer box 1 is covered by the outer cover 1*b* and sealed by a binding band RB and hook-and-loop fasteners MF.

Figures 8A, 8B, 8C, 8D, 8E, 8F, 8G:
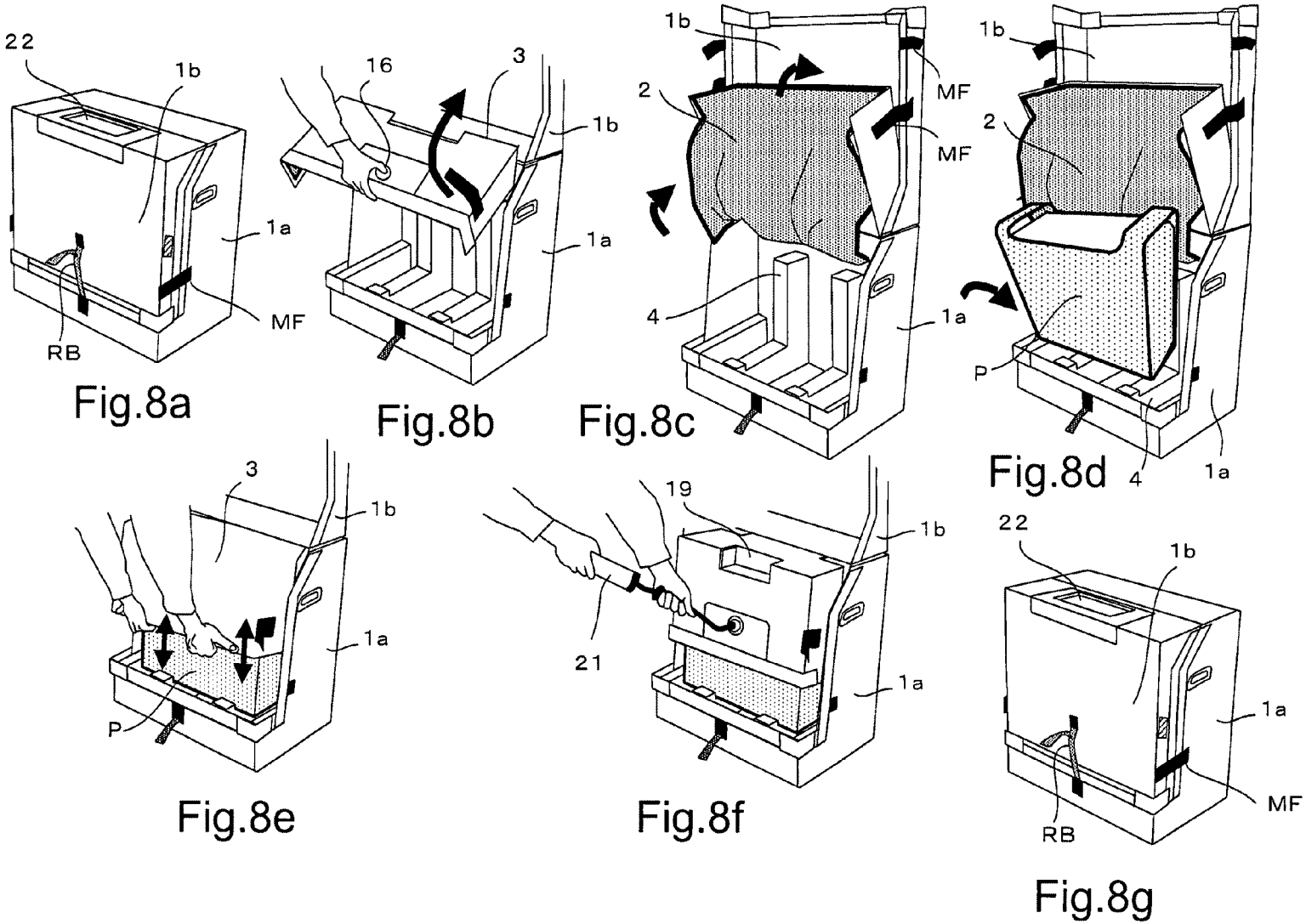
FIG. 8(*a*) to FIG. 8(*g*) are views showing steps of storing and packing an article in an outer box in order.
Figures 10A, 10B, 10C, 10D, 10E:
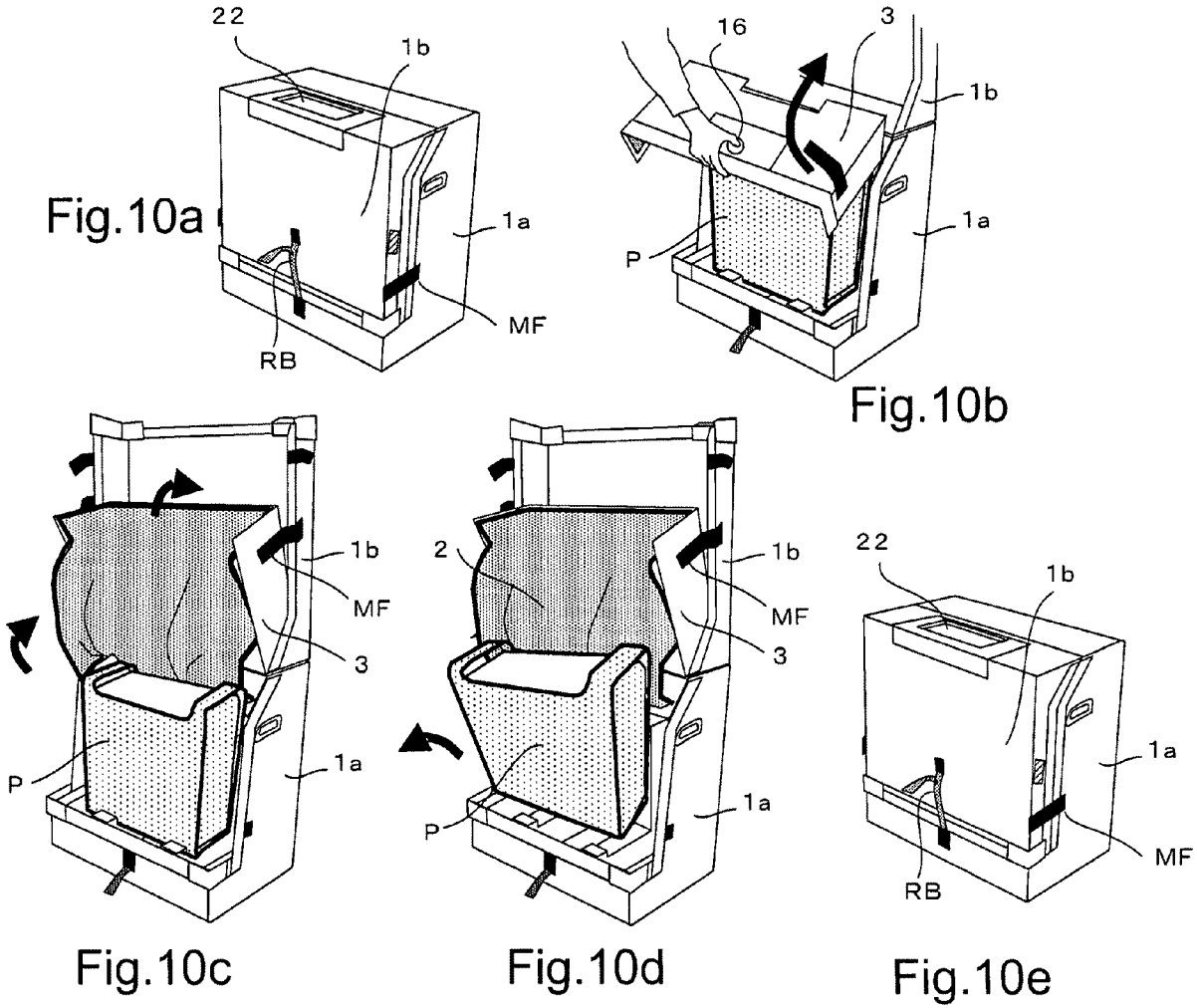
FIG. 10(*a*) to FIG. 10(*e*) are views showing steps of unpacking an article.

For example, a case where a client requests a home delivery service company to transport a comparatively large-sized article (product) such as a display of a desktop personal computer, etc., and the requested home delivery service company stores the requested article in a package box and delivered to a destination, will be considered. FIG. 8 show steps of packing an article in the package box, and FIG. 10 show steps of unpacking. When a client (customer of a home delivery service company) requests the home delivery service company to transport the article P, a home delivery service person carries a sealed package box to a place (home or office, etc.) designated by the client and receives the article P from the client.

In FIG. 8(*a*), the home delivery service person places the carried packaging unit according to the present invention on the floor or table at the place he/she visited, removes the hook-and-loop fasteners MF sealing the box main body 1*a* to the outer lid 1*b* and the binding band RB, and first, the home delivery service person lifts the outer lid 1*b* up and opens it up, and loosens the knob 15 of the valve 7 when the inside of the packaging mat 2 is deaerated, opens the air intake valve 10 by pushing the push button 16 by hand as shown in FIG. 8(*b*) to introduce the outside air into the packaging mat 2 through the air intake valve 10 and reduce the filling density of the cushioning bodies 5 inside the packaging mat 2, and after the solidified state is accordingly released, opens the inner lid 3 up.

In FIG. 8(*c*), the hook-and-loop fastener MF of the inner lid 3 is fastened to the hook-and-loop fastener MF of the outer lid 1*b* of the outer box to fix the inner lid 3 onto the outer lid 1*b*. Accordingly, the packaging mat 2 is spread between the bottom surface outer end of the inner lid and the outer end of the flap 3*d* (refer to FIG. 8(*c*)). Next, the article P to be stored is inserted in the outer box 1 and placed on the cushion 4 inside the box main body 1*a* so that the bottom surface and the back surface of the article P are supported by the cushion 4. At this time, the article P must be stored at a center portion of the box main body 1*a* so that spaces are secured on both sides of the article P between the article P and the box main body 1*a* (refer to FIG. 8(*d*)).

After the article P is stored in the box main body 1, the hook-and-loop fasteners MF are separated and the inner lid 3 falls down, and the surface of the packaging mat 2 is pressed against the article P by the surfaces of the box shape and the packaging mat 2 is covered on the surface of the article P. At this time, it is preferable that both ends of the packaging mat 2 are evenly distributed to the spaces on the left and right of the article P. Next, the pump 21 is removed from the pump storage space 19 of the inner lid 3, the knob 15 of the valve 7 is loosened (refer to FIG. 7), the mouth of the pump 21 is inserted into the valve cage 11 of the valve 7 and the pump 21 is operated to open the check valve 9 to evacuate the air inside the packaging mat 2.

By deaerating the inside of the packaging mat 2, the volume of the packaging mat 2 is reduced, and the filling density of the cushioning bodies 5 increases, and the packaging mat 2 is pushed by the surfaces of the inner lid 3 and fits the surface shape of the article P on the cushion 4 of the outer box, and the packaging mat 2 is solidified while wrapping portions of four surfaces of the article P, that is, the upper surface, the front surface, and both side surfaces of the article P when the stored article P is a hexahedron, and fixes and holds the article P supported on the cushion 4 at a fixed position inside the box main body 1*a*. After the inside of the packaging mat 2 is deaerated, the knob 15 of the valve 7 is tightened to block introduction of the outside air into the packaging mat 2, the pump 21 is returned to the storage space 19 of the inner lid 3, the outer lid 1*b* is moved down to close the opening of the box main body 1*a*, the box main body 1*a* and the outer lid 1*b* are fixed to each other by the hook-and-loop fasteners ME and further bound with the binding band RB (refer to FIG. 8(*g*)).

Figure 9:
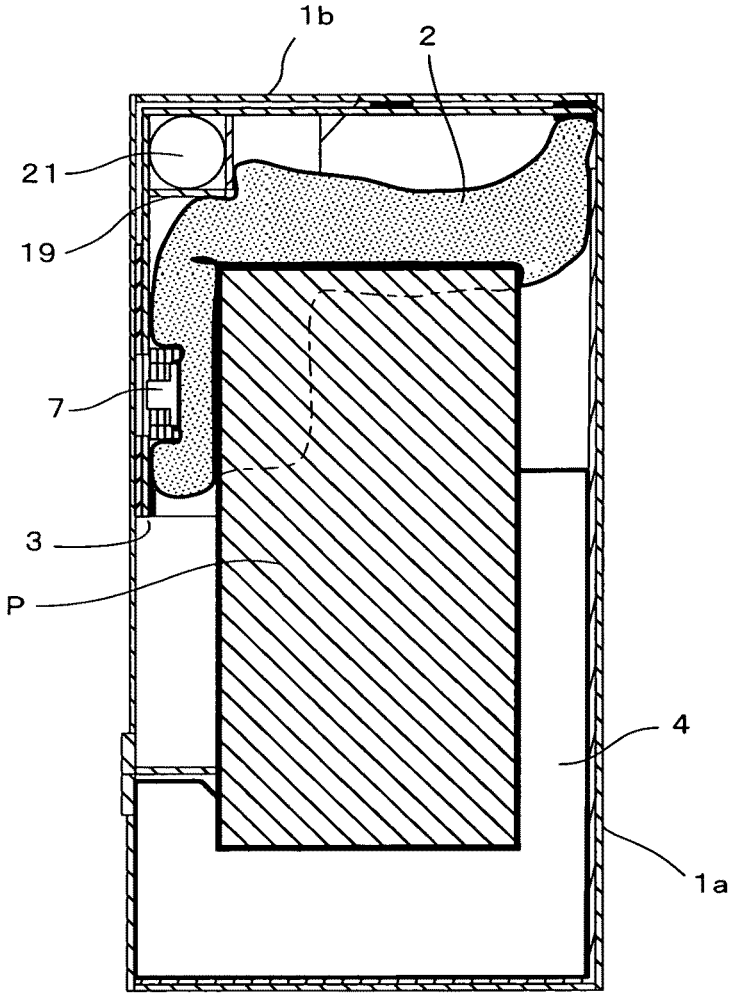
FIG. 9 is a view showing a state where an article is packed in an outer box.

In FIG. 9, the packaging mat 2 is supported on the inner lid 3 and deformed along the shape of the article by pressures applied by both left and right side surfaces of the inner lid, and wraps portions of the upper surface, front surface, and left and right side surfaces of the article and further extends and wraps a portion of the back surface of the article, and is solidified, and at least four remaining surfaces of the article P supported by the cushion inside the box main body 1*a* are held by the solidified packaging mat 2, and accordingly, the article P is fixed and held at a fixed position inside the outer box.

In the drawing, the reference numeral 22 denotes a delivery slip pocket. A delivery slip of the article P is put into the pocket 22, and the article is delivered to the destination indicated on the delivery slip. Not only is the article P stored in the outer box 1 stably held by the cushion 4 inside the box main body 1*a*, but also the cushioning bodies filled in the packaging mat 2 come into close contact with the article at a high density, so that the cushioning effect is increased, and therefore, the stored article is effectively protected from vibrations and impacts that may be applied thereto during transportation.

After the article is delivered to the destination, the outer box is unpacked at the delivery destination. At this time, as shown in FIG. 10(*a*), first, the hook-and-loop fasteners MF that fix the box main body 1 and the outer lid 1*b* to each other and the binding band RB are removed and the outer lid 1*b* is opened, the knob 15 of the valve 7 is loosened, the push button 16 is depressed to open the air intake valve 10 to introduce the outside air into the packaging mat 2 (refer to FIG. 10(*b*)).

Accordingly, the filling density of the cushioning bodies 5 is reduced and the tightness of the packaging mat 2 is relaxed. Thereafter, the inner lid 3 is lifted up, the inner lid 3 is fixed to the outer box 1*b* by the hook-and-loop fasteners MF and held in an upward tilting posture as shown in FIG. 10(*c*), and the article P is taken out from the box main body 1*a* (refer to FIG. 10(*d*)). When preparing the outer box from which the article P was taken out for the next delivery, first, the inner lid 3 is moved down, the outer lid 1*b* is closed, the box main body 1*a* and the outer lid 1*b* are fixed to each other by the hook-and-loop fasteners MF and bound by the binding band RB (refer to FIG. 10(*e*)).

In the examples described above, an example is shown in which the packaging mat 2 supported by the inner lid 3 wraps the upper surface, the front surface, and the left and right side surfaces of the article P stored in the box main body la and further extends and wraps a portion of the back surface of the article to hold the upper portion of the article so that the article is fixed and held. In this example, by supporting the packaging mat 2 by the inner lid 3 as a mat holder, by closing the inner lid, the packaging mat 2 can be made to automatically fit the shape of the article across the upper surface, both side surfaces, and the front surface of the article, and therefore, by deaerating the inside of the packaging mat 2 through the small hole 8 opened in the inner lid 3 in the state where the inner lid 3 is closed, the packaging mat 2 can be made to automatically fit the shape of the article and be solidified. Of course, the mat holder is not limited in use as an inner lid, but may be used only for supporting the packaging mat at a fixed position and pressing the packaging mat against the surfaces of the stored article before solidification.

However, to fix the article stored in the box main body to a fixed position, the mat holder is not always necessary. As long as at least a portion of the packaging mat wrapping the whole article is fixed to the outer box or the outer lid by hook-and-loop fasteners, etc., the article does not move inside the outer box even when it is subjected to vibrations and impacts, and can be effectively protected from impacts and vibrations by a cushioning effect obtained by solidification of the packaging mat. In addition, to hold the article at a fixed position inside the outer box, as shown in the above-described examples, it is also possible that a cushion is installed in the outer box, and the stored article is held by the cushion and the solidified packaging mat. The valve 7 is not limited to a valve formed by combining an air intake valve and a check valve inside and outside, but various valves can be used, and further, a valve the function of which can be switched between the function of a check valve and the function of an air intake valve may also be used.

In the present invention, it is required that the cushioning bodies are filled in the packaging mat and brought into pressure contact densely by deaerating the inside of the packaging mat, and brought into pressure contact with the surface of the article sandwiched by the packaging regions of the two-folded packaging mat, and a friction resistance necessary for preventing the article from being displaced laterally is obtained. In this regard, simple granular substances such as beads are brought into close contact and integrated with each other by the deaeration of the inside of the packaging mat and pressurize the article to prevent the article from being laterally displaced.

However, cushioning bodies that increase the filling density by the deaeration of the inside of the packaging mat and are solidified along the shape of the article are not limited to beads, and polystyrene-made amorphous pieces (these pieces are used as cushioning materials to be normally filled in a box together with an article when a normal delivery package is packed) and further, the pieces processed into a sheet or net may also be used.

Of course, an article to be packed in a package box of the present invention is not limited to a desktop personal computer, and the present invention is also applicable to home delivery services of precision machines and electronic equipment, etc., and transportation of a large number of thin articles such as CDs and DVDs stacked and packed.

INDUSTRIAL APPLICABILITY

An article packaging unit according to the present invention can be widely utilized for transportation of a commodity by a mover company or a home delivery service company, delivery of a commodity from a department store or retail store, and transportation of articles and papers between a factory and an office as well as delivery of a commodity from a retail store or a mass retailer to a purchaser, delivery of an article from a user of the article to a repair center so as to repair an article, and return of a repaired product from a repair center to the client.

DESCRIPTION OF THE REFERENCE NUMERALS

1: Outer box, 1*a*: Box main body, 1*b*: Outer lid, 2: Packaging mat, 2*a*: Surface sheet, 2*b*: Backside sheet, 3: Inner lid, 3*a*: Bottom surface, 3*b*: Rising surface, 3*c*: Back surface, 3*d*: Flap, 4: Cushion, 5: Cushioning body, 6: Outer sheet, 7: Valve, 8: Small hole, 9: Check valve, 9*a*: Filter, 9*b*: Ring, 9*c*: Valve plate, 9*d*: Holder, 10: Air intake valve, 10*a*: Tubular portion, 10*c*: Valve stem, 10*d*: Coil spring, 10*e*: Rubber packing, 11: Valve cage, 11*a*: Flange, 12: Coupler, 13: Cam groove, 14: Projection, 15: Knob, 16: Push button, 17: Stay, 18: Recess, 19: Pump storage space, 20: Ring, 21: Pump, 22: Pocket, P: Article, MF: Hook-and-loop fasteners, RB: Binding band

What is claimed is:

1. An article packaging unit for home delivery services, comprising:

a combination of at least an outer box and a packaging mat, wherein the outer box comprises a box main body and an outer lid, the outer box is a container that stores an article, the box main body is a hollow cube container having an opening part opening and extending from a part of a front surface of the box main body to a part of an upper surface of the box main body, and a cushion extending from a bottom surface of the box main body to a back surface of the box main body to hold the article therein, the outer lid is connected to an opening edge of the upper surface of the box main body such that the outer lid flaps to open and close the opening part of the box main body, the packaging mat is an airtight bag having cushioning bodies therein, at least a portion of the packaging mat is removably attached to an inside of the outer box, and the packaging mat has a valve thereon, the cushioning bodies solidify the packaging mat to bring the packaging mat into close contact with a surface of the article and lessen impacts applied from outside by fitting a shape of the article packed with the packaging mat and increasing a filling density in the airtight bag when air inside of the airtight bag of the packaging mat is evacuated and an internal capacity is reduced, the valve comprises a combination of a check valve and an air intake valve, the check valve opens when a suction force of a pump is applied when deaerating an inside of the packaging mat, and after deaeration, the check valve closes to block introduction of outside air into the packaging mat, the air intake valve introduces the outside air into the packaging mat, the inside of which is deaerated by a valve opening operation, the deaerated and solidified packaging mat holds the article at a fixed position, the cushion has a continuous L shape having a short side and a long side, and the short side has a step at an end thereof to hold the article between the step and the long side of the continuous L shape.

2. The article packaging unit for home delivery services according to claim 1, wherein the cushion holds the article stored in the outer box at the fixed position with the solidified packaging mat.

3. The article packaging unit for home delivery services according to claim 1, wherein the outer box has a mat holder, and the mat holder supports the packaging mat and presses the packaging mat against a portion of the surface of the article stored in the outer box before deaeration of the inside of the packaging mat.

4. An article packaging unit for home delivery services, comprising:

an outer box having a box main body, an inner lid, and a cushion supporting an article placed in the outer box thereon; and a packaging mat, wherein the inner lid is a mat holder that supports the packaging mat, and is supported in an openable and closable manner on the outer box, the inner lid makes the packaging mat fit along a surface of the article supported on the cushion of the outer box when the inner lid closes, the inner lid has a box shape whose rear and lower surfaces are open, a small hole which is an exhaust port of a valve provided in the packaging mat, on a front surface of the inner lid, and a flap on a back surface of the inner lid, the flap is removably attached to an upper bottom inner surface of the box main body, and the packaging mat is attached across the flap and the bottom surface of the inner lid.

5. The article packaging unit for home delivery services according to claim 4, wherein the packaging mat is laid across a back surface of the inner lid, and is pushed by surfaces of the inner lid and brought into contact with the surface of the article while fitting the packaging mat to a shape of the article on the cushion of the outer box when the inner lid is closed.

6. The article packaging unit for home delivery services according to claim 1, wherein the outer box has an inner lid having a box shape whose rear and lower surfaces are open, a small hole which is an exhaust port of a valve provided in the packaging mat, on a front surface of the inner lid, and a flap on a back surface of the inner lid, the flap is removably attached to an upper bottom inner surface of the box main body, and the packaging mat is attached across the flap and the bottom surface of the inner lid.

7. The article packaging unit according to claim 4, wherein the inner lid has a storage space, and a pump for deaerating an inside of the packaging mat is stored in the storage space in such a manner that the pump can be taken out from and put into the storage space.

8. The article packaging unit for home delivery services according to claim 4, wherein the outer box has an outer lid which is connected to an opening edge of an upper surface of the box main body such that the outer lid flaps to open and close an opening part of the box main body.

* * * * *